US008342676B2

(12) United States Patent
Ozaki et al.

(10) Patent No.: US 8,342,676 B2
(45) Date of Patent: Jan. 1, 2013

(54) PRINTING APPARATUS

(75) Inventors: Kazuma Ozaki, Okaya (JP); Kazuya Nomura, Matsumoto (JP); Yasuo Naramatsu, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 306 days.

(21) Appl. No.: 12/883,390

(22) Filed: Sep. 16, 2010

(65) Prior Publication Data

US 2011/0102531 A1 May 5, 2011

(30) Foreign Application Priority Data

Sep. 18, 2009 (JP) ..... 2009-216670

(51) Int. Cl.
*B41J 2/01* (2006.01)
*B41J 29/38* (2006.01)
*B41J 2/165* (2006.01)

(52) U.S. Cl. ..... 347/104; 347/16; 347/30; 347/36

(58) Field of Classification Search ..... None
See application file for complete search history.

(56) References Cited

U.S. PATENT DOCUMENTS

| | | | | |
|---|---|---|---|---|
| 6,672,720 | B2 * | 1/2004 | Smith | 347/104 |
| 6,714,232 | B2 * | 3/2004 | Kerr et al. | 347/262 |
| 6,733,109 | B1 * | 5/2004 | Lorenz et al. | 347/36 |
| 6,758,546 | B2 * | 7/2004 | Hinojosa et al. | 347/16 |
| 7,426,062 | B2 * | 9/2008 | Nojiri et al. | 358/3.24 |
| 2007/0291096 | A1 | 12/2007 | Toyoshima | |
| 2011/0102531 | A1 * | 5/2011 | Ozaki et al. | 347/104 |

FOREIGN PATENT DOCUMENTS

| | | |
|---|---|---|
| JP | 05-131692 | 5/1993 |
| JP | 11-305600 | 11/1999 |
| JP | 2007-098936 | 4/2007 |
| JP | 2008-254218 | 10/2008 |

* cited by examiner

*Primary Examiner* — Manish S Shah
*Assistant Examiner* — Alexander C Witkowski
(74) *Attorney, Agent, or Firm* — Workman Nydegger

(57) ABSTRACT

A printing apparatus includes a printing medium support unit that supports and guides a printing medium supplied to a print execution area. The printing medium support unit includes a support portion supporting the printing medium defines a predetermined gap with a print head. A suction groove is formed concavely on a support surface of the support portion. A suction opening in the suction groove communicates with a suction source. A movable adsorption portion in the suction groove has a suction hole. Before the printing medium is supplied, the movable adsorption portion is located at an upper limit position higher than a support height of the support portion. When the printing medium is supplied, the suction hole is blocked by the printing medium, creating negative pressure, and thus the movable adsorption portion is moved to a lower limit position no higher than the support height of the support portion.

7 Claims, 12 Drawing Sheets

PRINTING APPARATUS

BACKGROUND

1. Technical Field

The present invention relates to a printing apparatus including a suction groove and a suction hole adsorbing and supporting a printing medium in a printing medium support unit supporting the printing medium supplied to a print execution area.

2. Related Art

An ink jet printer which is an example of a printing apparatus will be described below. Among ink jet printers, there is an ink jet printer including a suction groove and a suction hole adsorbing and supporting a printing medium (hereinafter, also referred to as a "sheet") in a printing medium support unit (hereinafter, also referred to as a "sheet support unit") supporting the sheet supplied to a print execution area in order to stabilize the position of the sheet during printing, as disclosed in JP-A-2007-98936 and JP-A-2008-254218.

The suction groove may have various forms, as disclosed in JP-A-2007-98936 and JP-A-2008-254218, but the configuration and function of the suction groove are not considerably different between apparatuses. The sheet is adsorbed and supported by the suction force from the suction hole formed in the bottom of the suction groove in a fixed state and a negative pressure generated by blocking the upper surface of the suction groove by the sheet supplied onto the suction groove.

In the configurations of known suction groove and suction hole, however, it is difficult to adsorb and support the sheet relative to the support surface of the sheet support unit, since curling of a roll sheet is large and a distance between the sheet support unit and the sheet is large.

Even in a single sheet cut at a predetermined size, it is also difficult to adsorb and support the sheet relative to the support surface of the sheet support unit, when the end edge or the corners of the sheet may be curved and thus may be curled up.

When the sheet is not reliably adsorbed and supported relative to the support surface of the sheet support unit, a desired print quality may not be ensured. Moreover, transport trouble of the sheet may arise in that a print head may touch the print surface of the sheet or sheet may be jammed.

SUMMARY

An advantage of some aspects of the invention is that it provides a printing apparatus adsorbing and supporting even a considerably curled or curved printing medium relative to the support surface of a printing medium support unit.

According to a first aspect of the invention, there is provided a printing apparatus including a printing medium support unit supporting a printing medium supplied to a print execution area and guiding the printing medium being transported. The printing medium support unit includes: a support portion supporting the printing medium supplied to the print execution area and defining a predetermined gap with a print head; a suction groove formed concavely on a support surface of the support portion; a suction opening formed in the suction groove and communicating with a suction source; and a movable adsorption portion disposed in the suction groove and having a suction hole. Before the printing medium is supplied, the movable adsorption portion is located at an upper limit position higher than a support height of the support portion. When the printing medium is supplied, the suction hole is blocked by the printing medium, a space of negative pressure is formed on the basis of the suction source, and thus the movable adsorption portion is moved to a lower limit position equal to or lower than the support height of the support portion by the negative pressure.

In the printing apparatus according to the aspect of the invention, before the printing medium is supplied, the movable adsorption portion is located at the upper limit position higher than the support height of the support portion. When the printing medium is supplied, the suction hole is blocked by the printing medium, the space of negative pressure is formed on the basis of the suction source, and thus the movable adsorption portion is moved to the lower limit position equal to or lower than the support height of the support portion by the negative pressure. Therefore, the following advantages can be obtained.

Even when the printing medium is curled and curved, the movable adsorption portion having the suction hole is located at the upper limit position higher than the support height of the support portion. Therefore, the printing medium can reliably be adsorbed and supported. In addition, by moving the movable adsorption portion in the adsorbed state to the lower limit position equal to or lower than the support height of the support portion, the curved or curled state of the printing medium can be corrected. In this way, since the predetermined gap between the support portion and the print head is maintained, the print execution quality is improved. Accordingly, it is possible to prevent the transport trouble such as the printing medium touching or blocking the print head.

According to a second aspect of the invention described in the printing apparatus according to the first aspect, the movable adsorption portion may include: a plate-shaped pressure receiving portion in which the suction hole is formed; and a pressure receiving sheet which is disposed so as to cover a space between a circumference of the pressure receiving portion and a circumference of the suction groove and is deformed flexibly.

According to the aspect, the movable adsorption portion can be realized by the simple configuration having the pressure receiving portion in which the suction hole is formed and the pressure receiving sheet. That is, the pressure receiving portion can be moved between the upper limit position and the lower limit position by the flexible deformation of the pressure receiving sheet. Moreover, the printing medium does not become stuck in a step difference between the circumference of the pressure receiving portion and the circumference of the suction groove, but can smoothly be guided onto the pressure receiving portion by the guiding operation of the pressure receiving sheet covering the space between the circumference of the pressure receiving portion and the circumference of the suction groove.

According to a third aspect of the invention described in the printing apparatus according to the first aspect, the movable adsorption portion may include: a plate-shaped pressure receiving portion in which the suction hole is formed; and a tubular wrinkle portion disposed across a bottom of the suction groove from a circumference of the pressure receiving portion.

According to the aspect, the movable adsorption portion can be realized by the simple configuration having the pressure receiving portion in which the suction hole is formed and the wrinkle portion. That is, the pressure receiving portion can be moved between the upper limit position and the lower limit position by expansion and contraction of the wrinkle portion. Moreover, since the volume of the enclosed space of the lower portion of the pressure receiving portion is decreased due to the wrinkle portion disposed across the bottom of the suction groove from the circumference of the pressure receiving portion, the suction force is improved. Accordingly, the printing medium can be adsorbed and supported more reliably.

According to a fourth aspect of the invention described in the printing apparatus according to the first aspect, the movable adsorption portion may include a cap-shaped pressure receiving tube including: a flat pressure receiving portion in which the suction hole is formed; and a side body portion extending from a circumference of the pressure receiving portion to a bottom of the suction groove.

According to the aspect, the movable adsorption portion includes the single pressure receiving tube integrally including the flat pressure receiving portion and the side body portion. Therefore, since the movable adsorption portion can be formed by injection molding, a troublesome assembly work is not necessary. Moreover, since an airtight property is improved by inserting the pressure receiving tube into the suction groove without a gap, the suction force can be improved. Furthermore, when a small gap is formed between the pressure receiving tube and the suction groove, the suction is executed from the gap and thus the suction area can be increased.

According to a fifth aspect of the invention described in the printing apparatus according to any one of the first to fourth aspects, the movable adsorption portion may be transited to the upper limit position by an urging force of an urging member.

According to the aspect, the movable adsorption portion is smoothly and reliably transited from the lower limit position to the upper limit position. Moreover, due to the presence of the urging member, the printing medium can be prevented from being excessively pulled in the suction groove.

According to a sixth aspect of the invention descried in the printing apparatus according to the aspect, an abutting portion which sets either or both of the upper limit position and the lower limit portion of the movable adsorption portion may be disposed in either or both of the movable adsorption portion and the suction groove.

According to the aspect, the upper limit position and the lower limit position as the operation height of the movable adsorption portion relative to the printing medium can be exactly managed. Therefore, the printing medium can be smoothly adsorbed and supported, the printing can be executed with high precision, and the transport can be executed reliably.

According to a seventh aspect of the invention described in the printing apparatus according to any one of the first to sixth aspects, a guide inclination surface burying a step difference between a circumference of the movable adsorption portion and a circumference of the suction groove may be formed between the circumference of the movable adsorption portion and the circumference of the suction groove.

According to the aspect, the printing medium supplied to the print execution area can smoothly be guided by the guide inclination surface and reach the position of the suction hole of the movable adsorption portion without being sucked in the step difference between the circumference of the protruding movable adsorption portion and the circumference of the suction groove.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a printing apparatus according to eight embodiments of Embodiment 1 to Embodiment 8 of the invention will be described in detail with reference to the drawings. First, an ink jet printer 1 according to exemplary embodiments of the invention is used as an example of the printing apparatus. The overall inner configuration of the ink jet printer 1 will be described.

Figure 1:
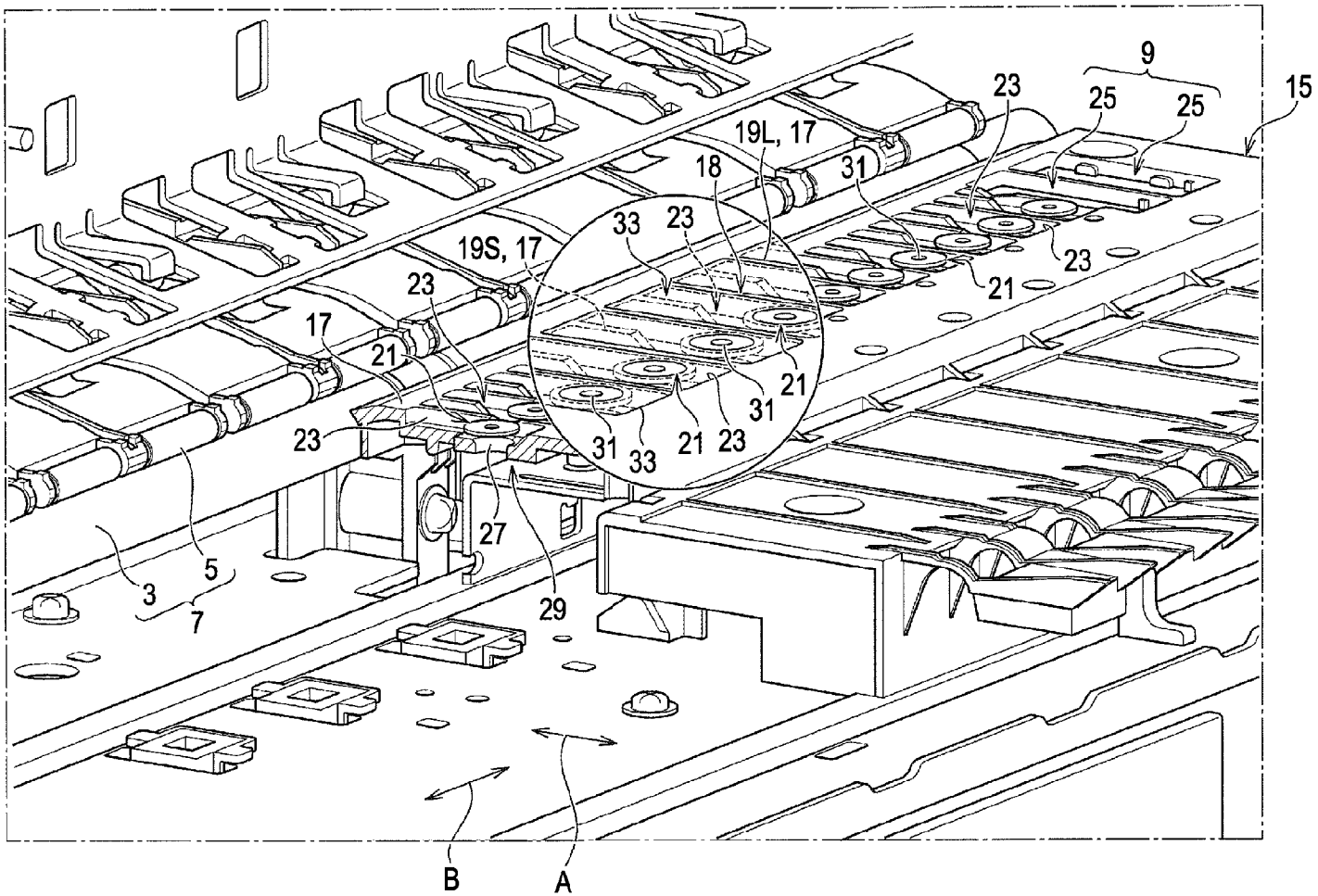
FIG. 1 is a partially exploded perspective view illustrating the periphery of a sheet support unit of an ink jet printer according to Embodiment 1 of the invention.
Figure 2:
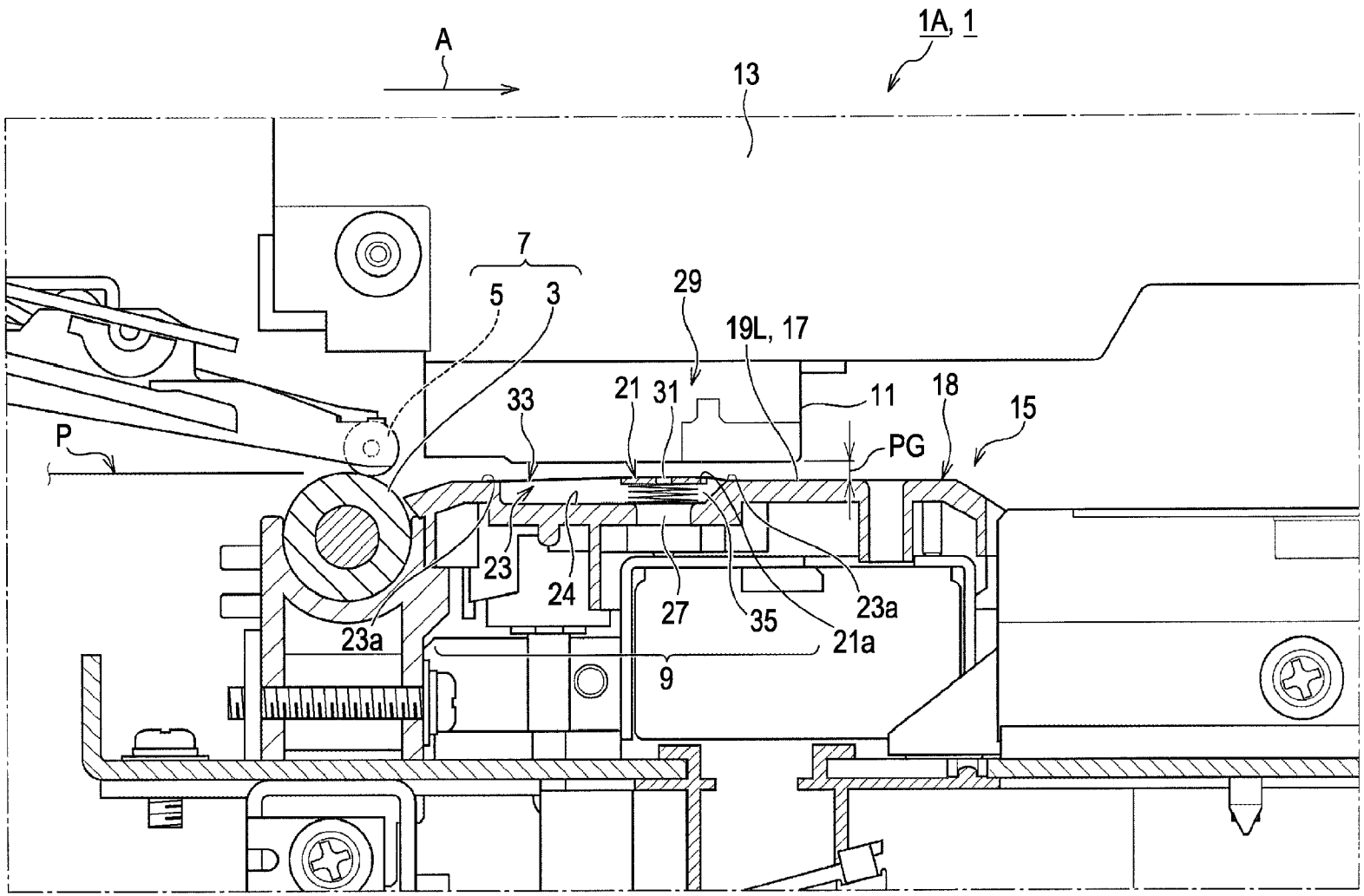
FIG. 2 is a side sectional view illustrating the periphery of the sheet support unit of the ink jet printer according to Embodiment 1 of the invention.

The illustrated ink jet printer 1 is an ink jet printer that is capable of executing printing on both sheets P of a roll sheet and a single sheet. As shown in FIGS. 1 and 2, a print execution area 9 is formed on the downstream side in a transport direction A of transport rollers 7, which include a pair of transport driving roller 3 and transport driven roller 5.

For example, a print head 11 executing the printing by ejecting ink toward the print surface of the sheet P is disposed above the print execution area 9. For example, the print head 11 is mounted on a carriage 13 reciprocating in a width direction B of the sheet P intersecting the transport direction A of the sheet P.

For example, on the lower side of the print execution area 9, a sheet support unit 15 is disposed to hold the sheet P supplied to the print execution area 9 and guide the transport of the sheet P.

The sheet support unit 15 is a unit with a rectangular shape long in the width direction B in a plan view. For example, a support portion 17 coming into direct contact with and supporting the sheet P supplied to the print execution area 9 and defining a predetermined gap PG with the print head 11 is disposed on the upper surface of the sheet support unit 15. In the illustrated ink jet printer 1, parts of the support portion 17 are formed by support ribs 19 extending in the transport direction A. The support ribs 19 are formed as a plurality of lines formed at an appropriate interval in the width direction B.

For example, the support ribs 19 include support ribs 19S having a short length and guiding the sheet P onto a pressure receiving portion 21, which is described below, and support ribs 19L having a long length and disposed on the right and left sides of the support ribs 19S having the short length. Suction grooves 23 and ink discard grooves 25 are appropriately assigned in the width direction B by the support ribs 19L having the long length.

The suction groove 23 is a concave portion which has a rectangular shape in a plan view, for example, and has a predetermined depth. In the suction groove 23, an enclosed space is formed therein when the opening of the upper surface is blocked by the supply of the sheet P. A suction opening 27 connected to one end of a suction passage (not shown) is formed in the middle or the like of the bottom 24 of the suction groove 23. A suction source (not shown) formed by a suction fan or the like generating a suction force S is connected to the other end of the suction passage (not shown).

The ink discard groove 25 is a concave portion which collects ink possibly discarded upon executing so-called marginless printing to print an image across the entire print surface of the sheet P. On the bottom of the ink discard groove 25, a collection opening (not shown) is connected to one end of the collection passage (not shown) extending toward a cartridge type waste ink tank (not shown).

A movable adsorption portion 29, which is the characteristic constituent element of the invention described in detail below, is disposed in each of the plurality of suction grooves 23.

In the movable adsorption portion 29, a suction hole 31 with a diameter smaller than that of the suction opening 27 is formed to apply the suction force to the enclosed space formed in the suction groove 23. The movable adsorption portion 29 is movably located at an upper limit position H1 higher than a support height H0 of the support portion 17 at the time of no load (state where the opening of the suction groove 23 is not blocked by the sheet P) before the sheet P is supplied. In addition, the movable adsorption portion 29 is located at the same position as the support height H0 of the support portion 17 or a position lower than the lower limit position H2 at the time of load (state where the opening of the suction groove 23 is blocked by the sheet P) when the sheet P is supplied.

Embodiment 1 (see FIGS. 1 to 5)

In an ink jet printer 1A (to which sign A is attached to distinguish the ink jet printer of Embodiment 1 from the ink jet printer of other embodiments) according to Embodiment 1, the movable adsorption portion 29 includes: a plate-shaped pressure receiving portion 21 in which a suction hole 31 is formed; and a pressure receiving sheet 33, which extends to cover a space between an upper circumference 21*a* of the pressure receiving portion 21 and an upper circumference 23*a* of the suction groove 23 and can be flexibly deformed.

Figure 3:
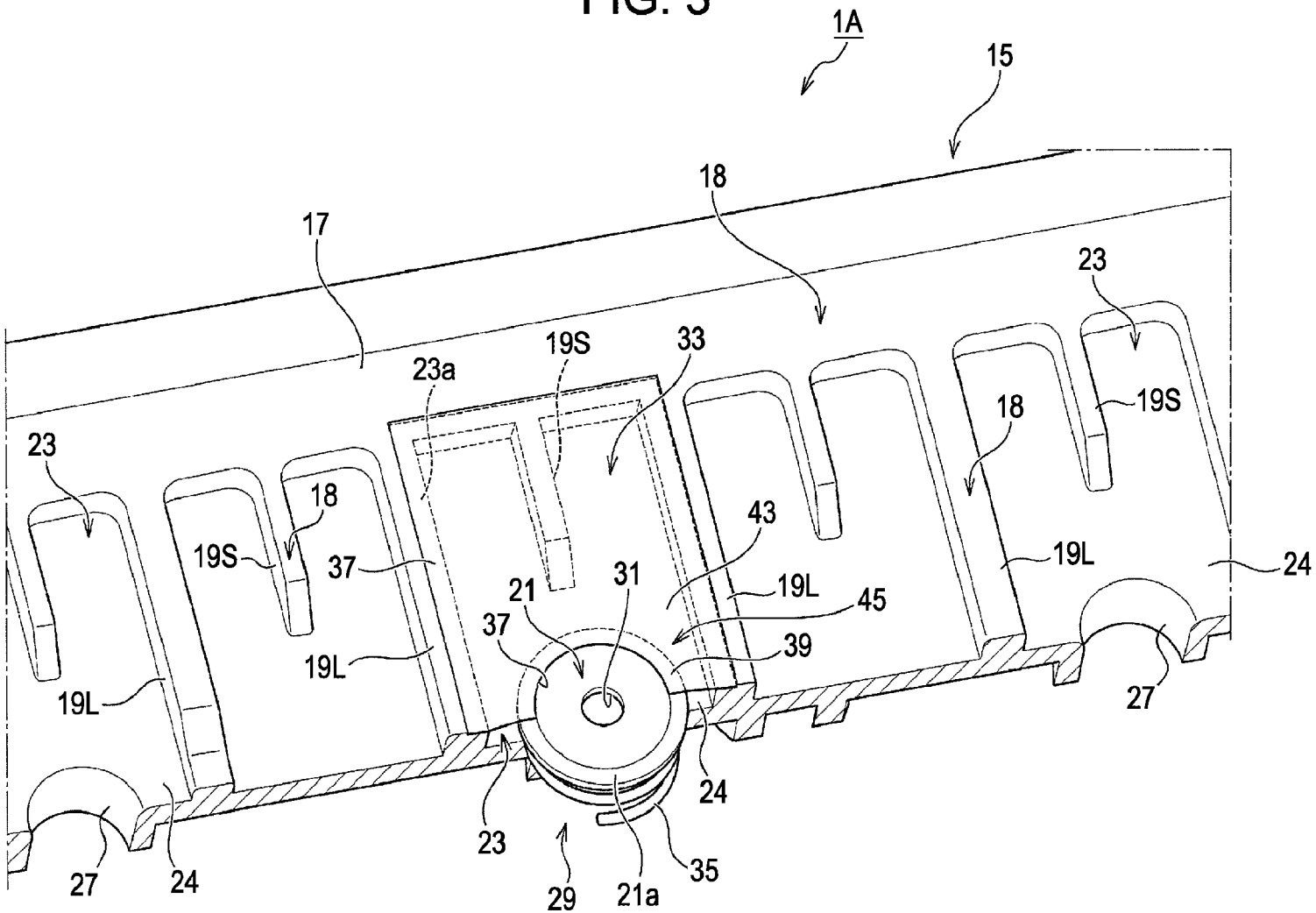
FIG. 3 is a partially exploded perspective view illustrating the sheet support unit according to Embodiment 1 of the invention.

As shown in FIG. 3, the pressure receiving portion 21 is formed by a circular plate member in which the suction hole 31 is formed in the middle thereof.

Figure 4:
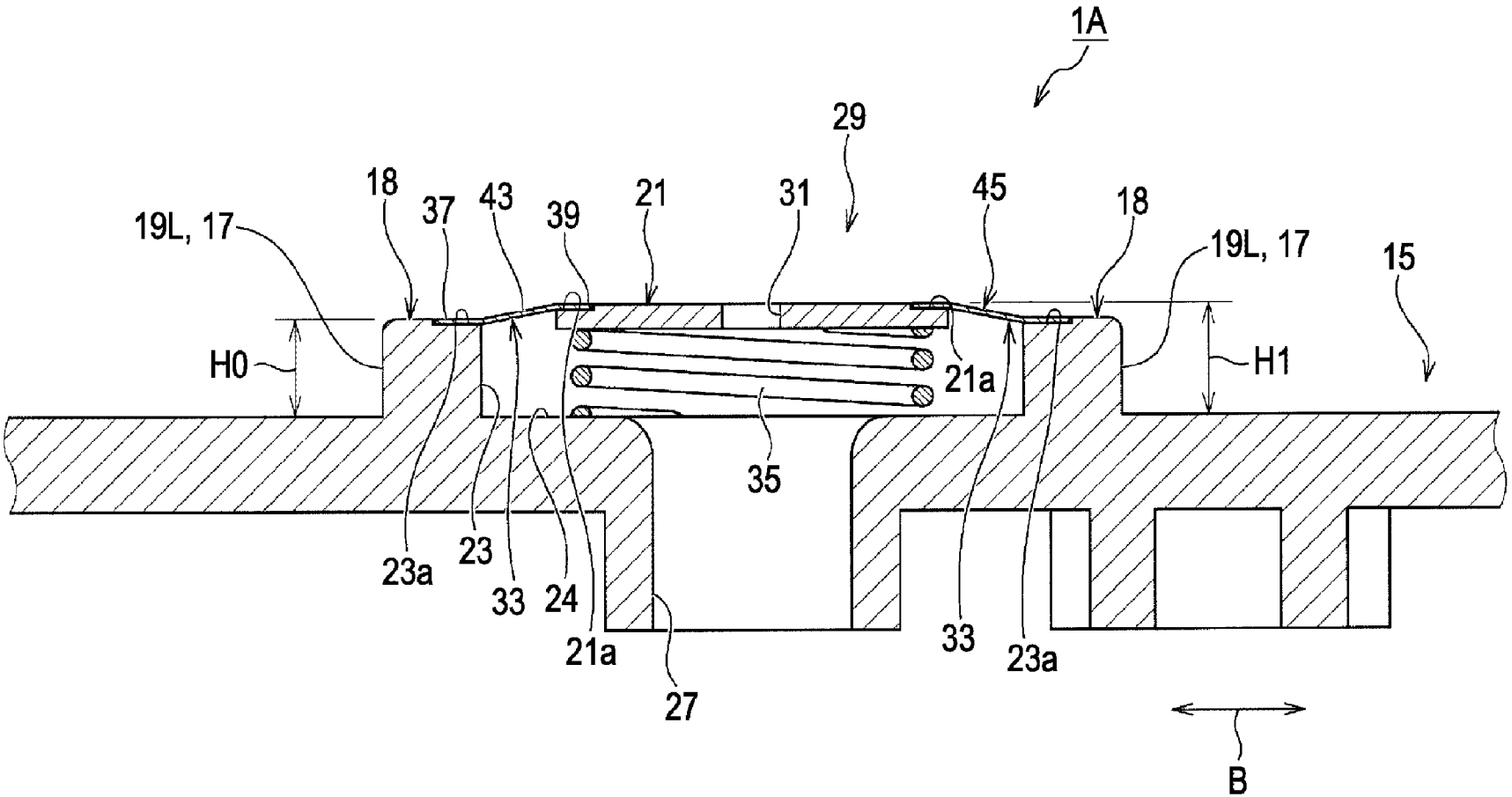
FIG. 4 is a longitudinal sectional front view illustrating an enlarged periphery of a part of a movable adsorption portion at the time of no load according to Embodiment 1 of the invention.
Figure 5:
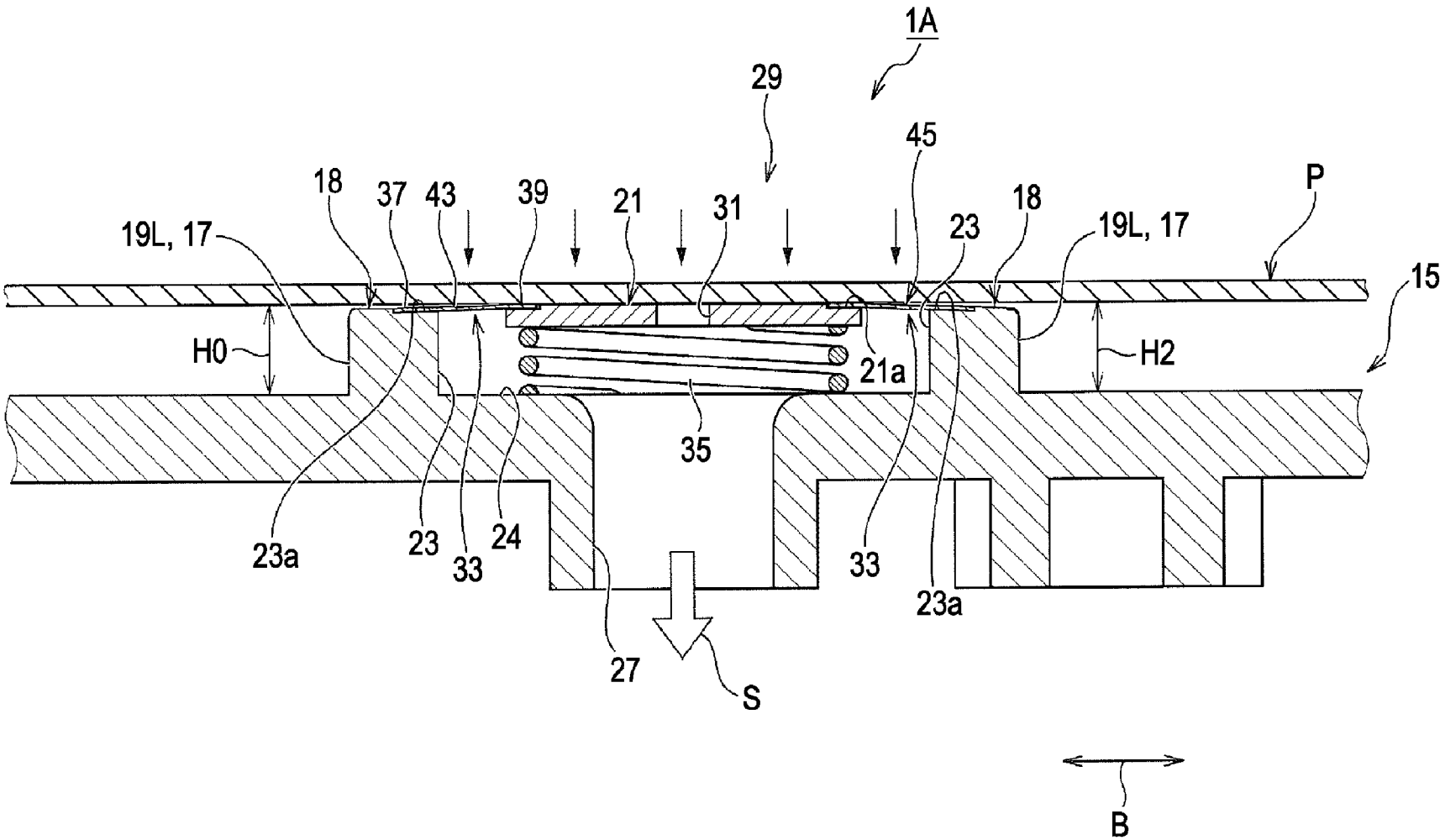
FIG. 5 is a longitudinal sectional front view illustrating an enlarged periphery of a part of a movable adsorption portion at the time of load according to Embodiment 1 of the invention.

As shown in FIGS. 4 and 5, a compression coil spring 35, which is an example of an urging member typically urging the pressure receiving portion 21 in an upward direction (direction approximating the sheet P), is installed between the pressure receiving portion 21 and the bottom 24 of the suction groove 23.

In the pressure receiving sheet 33, as shown in FIG. 3, an outer circumference 37 is made concave in a step difference portion formed by hollowing the upper circumference 23*a* of the suction groove 23 and having a rectangular shape in a plan view. The pressure receiving sheet 33 is a thin member having a circular opening 37 in which an inner circumference 39 is made concave in the upper circumference 21*a* of the pressure receiving portion 21 and which has a rectangular shape in a plan view and has a size slightly smaller than that the diameter of the pressure receiving portion 21. The material of the pressure receiving sheet 33 is not particularly limited, as long as the material meets the conditions of a sealing property and flexibility.

The upper surface of an intermediate portion 43 between the outer circumference 37 and the inner circumference 39 is formed as a guide inclination surface 45 burying a step difference formed between the upper circumference 21*a* of the pressure receiving portion 21 and the upper circumference 23*a* of the suction groove 23.

When the leading end of the sheet P reaches the movable adsorption portion 29 located at the upper limit position H1 shown in FIG. 4, the inner space of the suction groove 23 is enclosed by covering the suction hole 31 with the leading end of the sheet P.

The inner space of the suction groove 23 becomes a negative pressure state to correspond to the stiffness of the sheet P by the above-described suction force S generated by the suction source (not shown). Therefore, the pressure receiving portion 21 and the sheet P are sucked toward the bottom 24 of the suction groove 23.

The pressure receiving portion 21 and the sheet P are moved to the bottom 24 of the suction hole 23 against the urging force of the compression coil spring 35, and reach the lower limit position H2 shown in FIG. 5. The sheet P moved in this state reaches a support surface 18 of the support portion 17 and is supported. Then, the curving and curling occurring initially in the sheet P is corrected and the sheet P becomes flat. That is, the predetermined gap PG with the print head 11 is maintained. Therefore, the printing is executed with high precision and the sheet P is smoothly transported.

Figure 6:
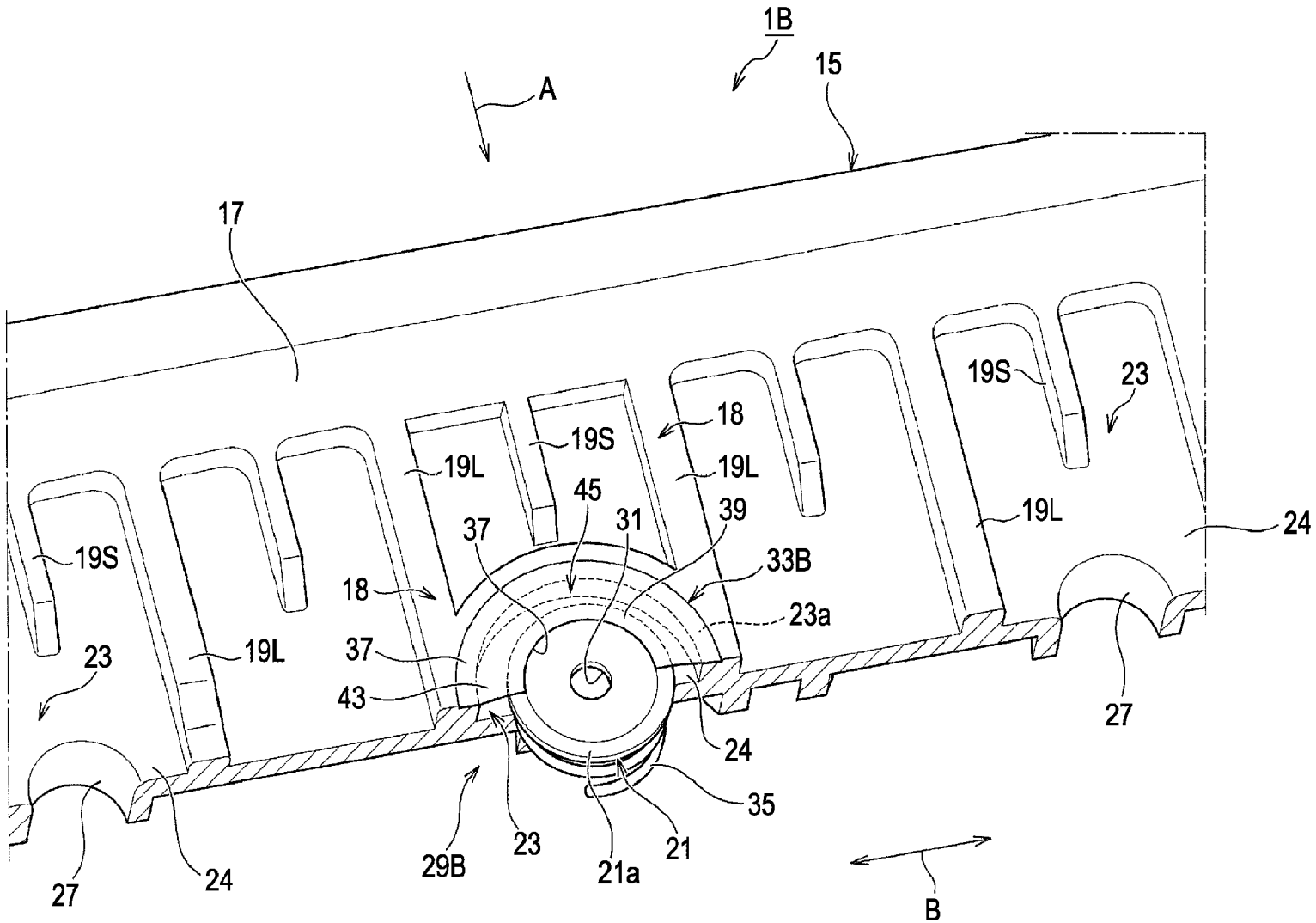
FIG. 6 is a partially exploded perspective view illustrating a sheet support unit according to Embodiment 2 of the invention.

Embodiment 2 (see FIG. 6)

An ink jet printer 1B (to which sign B is attached to distinguish the ink jet printer of Embodiment 2 from the ink jet printer of other embodiments) according to Embodiment 2 includes a pressure receiving portion 21, of which a movable adsorption portion 29B is the same as that of Embodiment 1, and a pressure receiving sheet 33B which has a shape different from that of Embodiment 1.

The suction groove 23B is larger than the pressure receiving portion 21 and has a circular shape in a plan view. The pressure receiving sheet 33B also has a circular shape in a plan view to correspond to the shape of the suction groove 23B. The same compression coil spring 35 as that of Embodiment 1 is installed between the pressure receiving portion 21 and the bottom 24 of the suction groove 23.

With the movable adsorption portion 29B, it is possible to obtain the same advantage as that of Embodiment 1. Moreover, since the suction force is increased with a decrease in the volume of the suction groove 23B, the sheet P can be reliably adsorbed and supported. The mechanical strength of the sheet support unit 15 is increased. Since the size of the pressure receiving sheet 33B is decreased, a yield is improved and thus material cost can be reduced.

Figure 7:
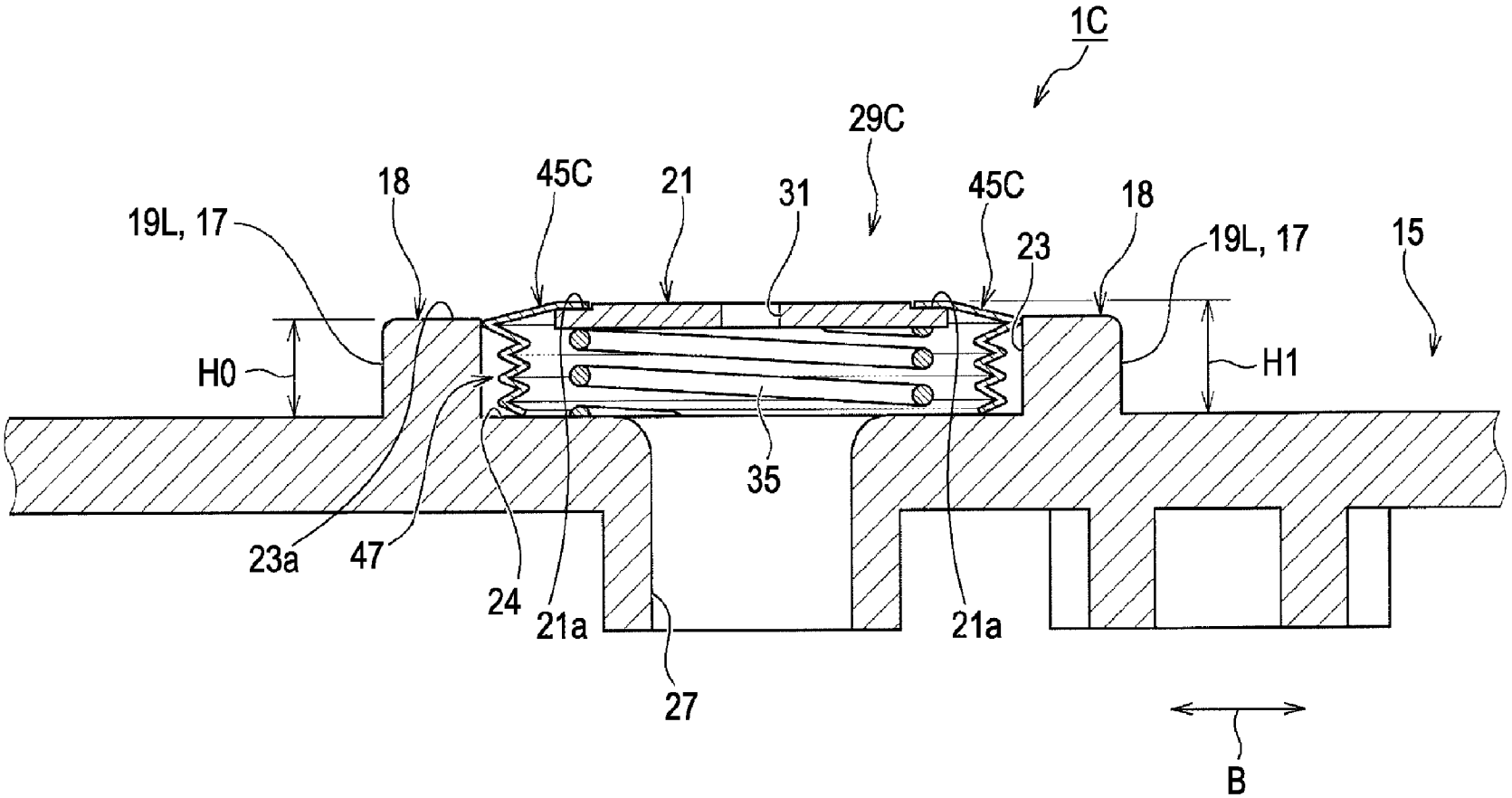
FIG. 7 is a longitudinal sectional front view illustrating an enlarged periphery of a part of a movable adsorption portion at the time of no load according to Embodiment 3 of the invention.

Embodiment 3 (see FIG. 7)

An ink jet printer 1C (to which sign C is attached to distinguish the ink jet printer of Embodiment 3 from the ink jet printer of other embodiments) according to Embodiment 3 includes the pressure receiving portion 21 of which the movable adsorption portion 29C is the same as that of Embodiment 1 and a wrinkle portion 47 which is installed across the bottom 24 of the suction hole 23 from the upper circumference 21*a* of the pressure receiving portion 21 instead of the pressure receiving sheet 33 of Embodiment 1 and has a tubular shape which can be expanded and contracted.

The top portion of the wrinkle portion 47 is configured to bury the step difference between the upper circumference 21*a* of the pressure receiving portion 21 and the upper circumference 23*a* of the suction groove 23. Specifically, the top portion of the wrinkle portion 47 serves as a guide inclination surface 45C guiding the sheet P to the suction hole 31 of the pressure receiving portion 21. The same compression coil spring 35 as that of Embodiment 1 is installed between the pressure receiving portion 21 and the bottom 24 of the suction groove 23.

With the movable adsorption portion 29C, it is possible to obtain the same advantage as that of Embodiment 1. Moreover, since the volume of the enclosed space in the lower portion of the pressure receiving portion 21 is decreased due to the wrinkle portion 47, the suction force is improved and thus the sheet P can be more reliably adsorbed and supported.

Figure 8:
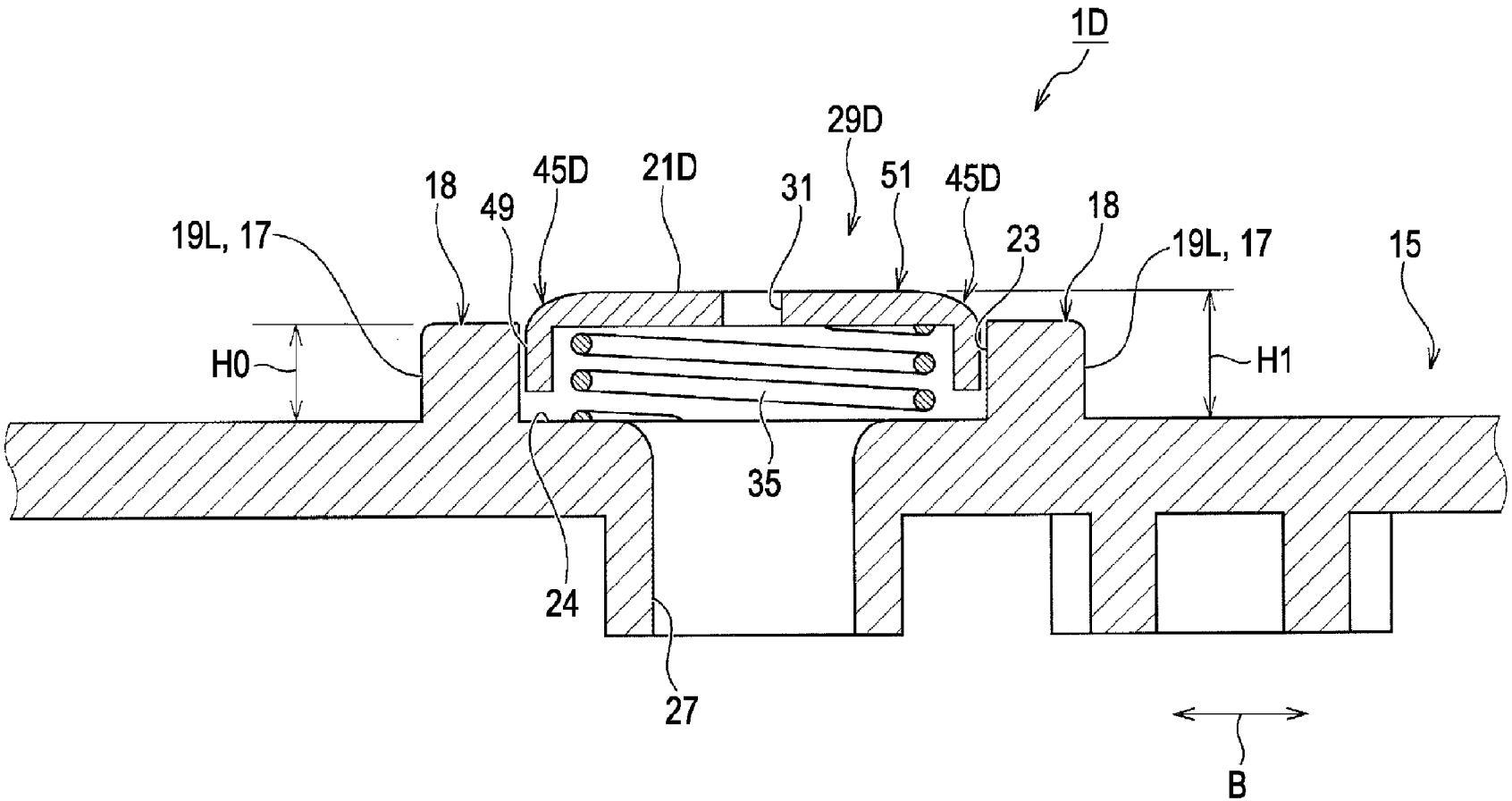
FIG. 8 is a longitudinal sectional front view illustrating an enlarged periphery of a part of a movable adsorption portion at the time of no load according to Embodiment 4 of the invention.

Embodiment 4 (see FIG. 8)

In an ink jet printer 1D according to Embodiment 4, a movable adsorption portion 29D (to which sign D is attached to distinguish the ink jet printer of Embodiment 4 from the ink jet printer of other embodiments) includes a cap-shaped pressure receiving tube 51 integrally having a flat pressure receiving portion 21D in which a suction hole 31 is formed, and a side body portion 49 extending from the circumference of the pressure receiving portion 21D toward the bottom 24 of the suction groove 23.

In this embodiment, the movable adsorption portion 29D is directly recessed inward in the suction groove 23 without forming the pressure receiving sheet 33, which is installed in Embodiment 1.

The boundary between the pressure receiving portion 21D protruding from the suction groove 23 and the side body portion 49 is formed in a curved shape, for example. Therefore, the boundary serves as the guide inclination surface 45 removing the influence of the step difference formed between the upper circumference 21*a* of the pressure receiving portion 21 and the upper circumference 23*a* of the suction groove 23.

In the pressure receiving tube 51, the same compression coil spring 35 as that of Embodiment 1 is installed between the pressure receiving portion 21D and the bottom 24 of the suction groove 23.

With the movable adsorption portion 29D, it is possible to obtain the same advantage as that of Embodiment 1. Moreover, since the movable adsorption portion 29D can be formed effectively by injection molding, for example, cumbersome work of assembling the movable adsorption portion 29D is not necessary. An airtight property is improved by inserting the pressure receiving tube 51 into the suction groove 23 without a gap. When a space is slightly formed between the pressure receiving tube 51 and the suction groove 23, the suction can be realized from the space and thus the suction area is increased.

Figure 9:
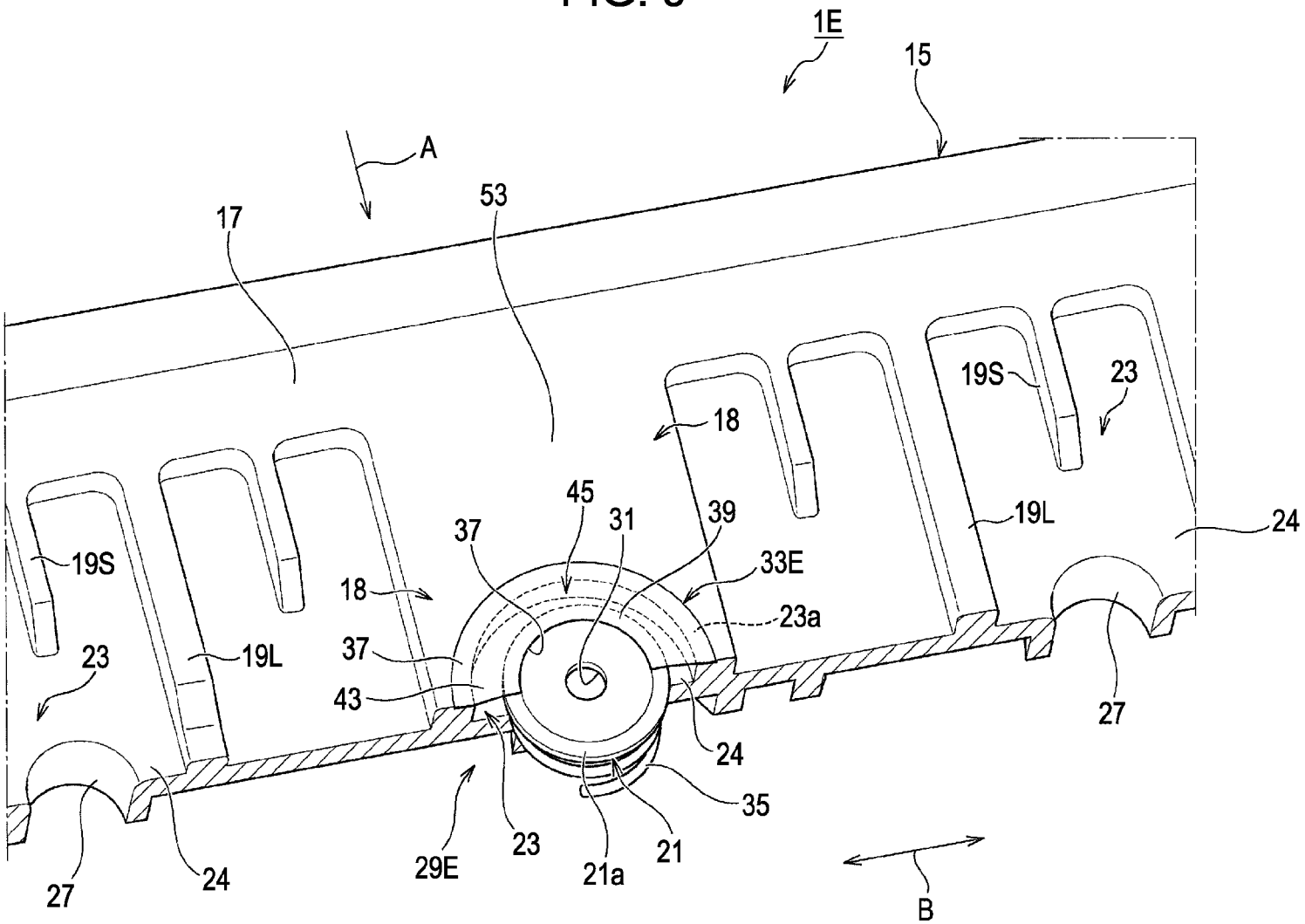
FIG. 9 is a partially exploded perspective view illustrating a sheet support unit according to Embodiment 5 of the invention.

Embodiment 5 (see FIG. 9)

An ink jet printer 1E (to which sign E is attached to distinguish the ink jet printer of Embodiment 5 from the ink jet printer of other embodiments) according to Embodiment 5 basically has the same configuration as that of the ink jet printer 1B of Embodiment 2 shown in FIG. 6. The movable adsorption portion 29B of Embodiment 2 is used as a movable adsorption portion 29E without change.

In this embodiment, the configuration of the support portion 17 guiding the sheet P to the movable adsorption portion 29E is different from that of Embodiment 2. In Embodiment 2, the support rib 19S having the short length disposed in the middle and the two support ribs 19L having the long length disposed on the right and left sides of the support rib 19S guide the sheet P to the movable adsorption portion 29B. In this embodiment, however, flat single support table 53 guides the sheet P.

With the ink jet printer 1E including the support table 53 having this configuration, it is possible to obtain the same advantage as that of Embodiment 1 and Embodiment 2. Moreover, since the support position of the sheet P can be flatly supported more reliably due to the expansion of the support area supporting the sheet P, the quality of the printing can be improved and the sheet P can be smoothly transported without jamming.

Figure 10:
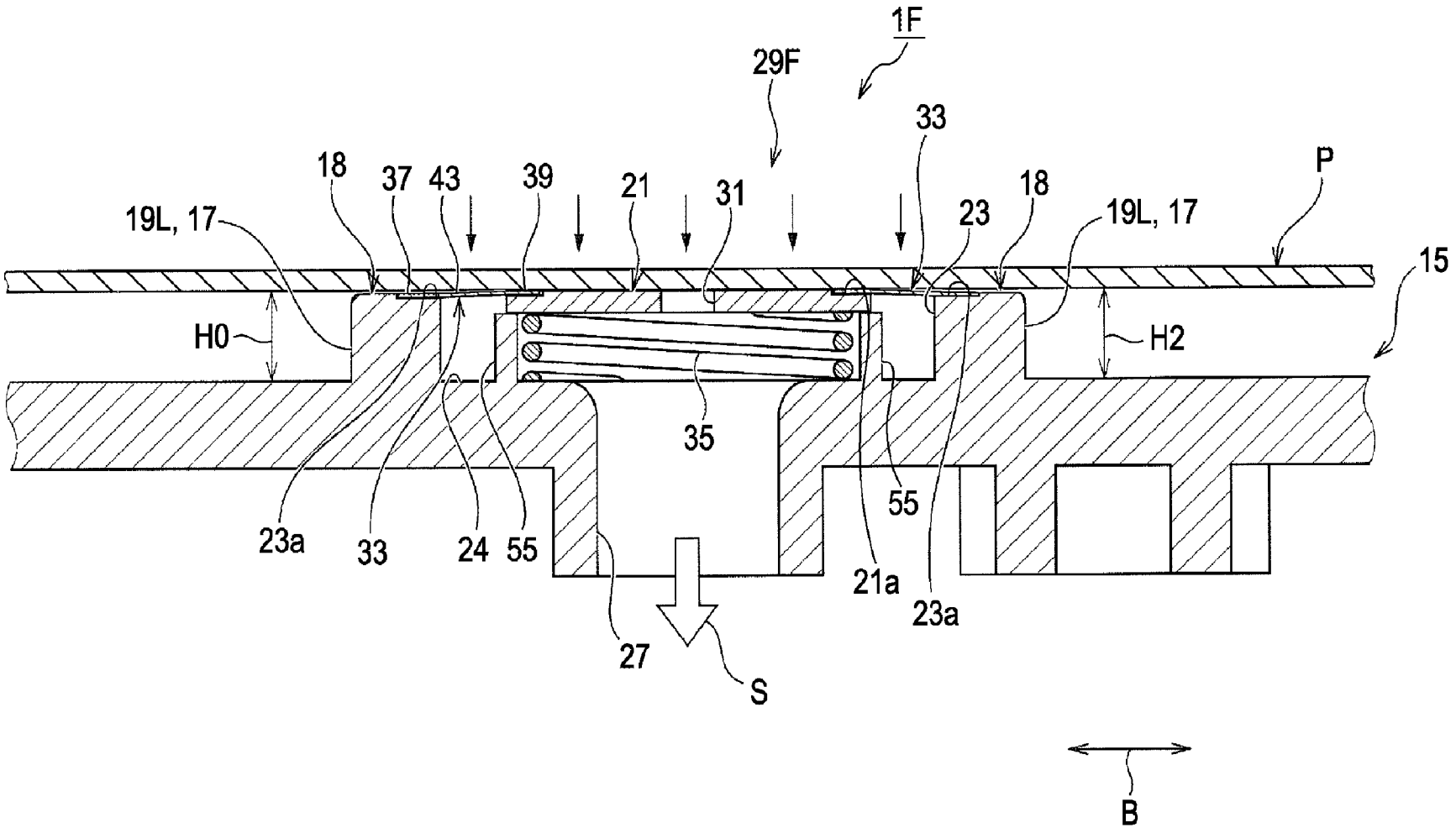
FIG. 10 is a longitudinal sectional front view illustrating an enlarged periphery of a part of a movable adsorption portion at the time of load according to Embodiment 6 of the invention.

Embodiment 6 (see FIG. 10)

An ink jet printer 1F (to which sign F is attached to distinguish the ink jet printer of Embodiment 6 from the ink jet printer of other embodiments) according to Embodiment 6 basically has the same configuration as that of the ink jet printer 1A of Embodiment 1 shown in FIGS. 1 to 5. Therefore, the movable adsorption portion 29F includes the pressure receiving portion 21, the pressure receiving sheet 33, and the compression coil spring 35, which are the same as those of Embodiment 1.

In this embodiment, an abutting portion 55 is disposed on the bottom 24 of the suction groove 23. Since the lower surface of the pressure receiving portion 21 comes into contact with the upper surface of the abutting portion 55, the lower limit position H2 of an operation height of the pressure receiving portion 21 to the sheet P is set.

With the movable adsorption portion 29F having this configuration, it is possible to obtain the same advantage as that of Embodiment 1. Moreover, since the lower limit position H2 of the operation height of the pressure receiving portion 21 to the sheet P is exactly managed, the sheet P can be smoothly adsorbed and supported, the printing can be executed with high precision, and the transport can be executed reliably.

Figure 11:
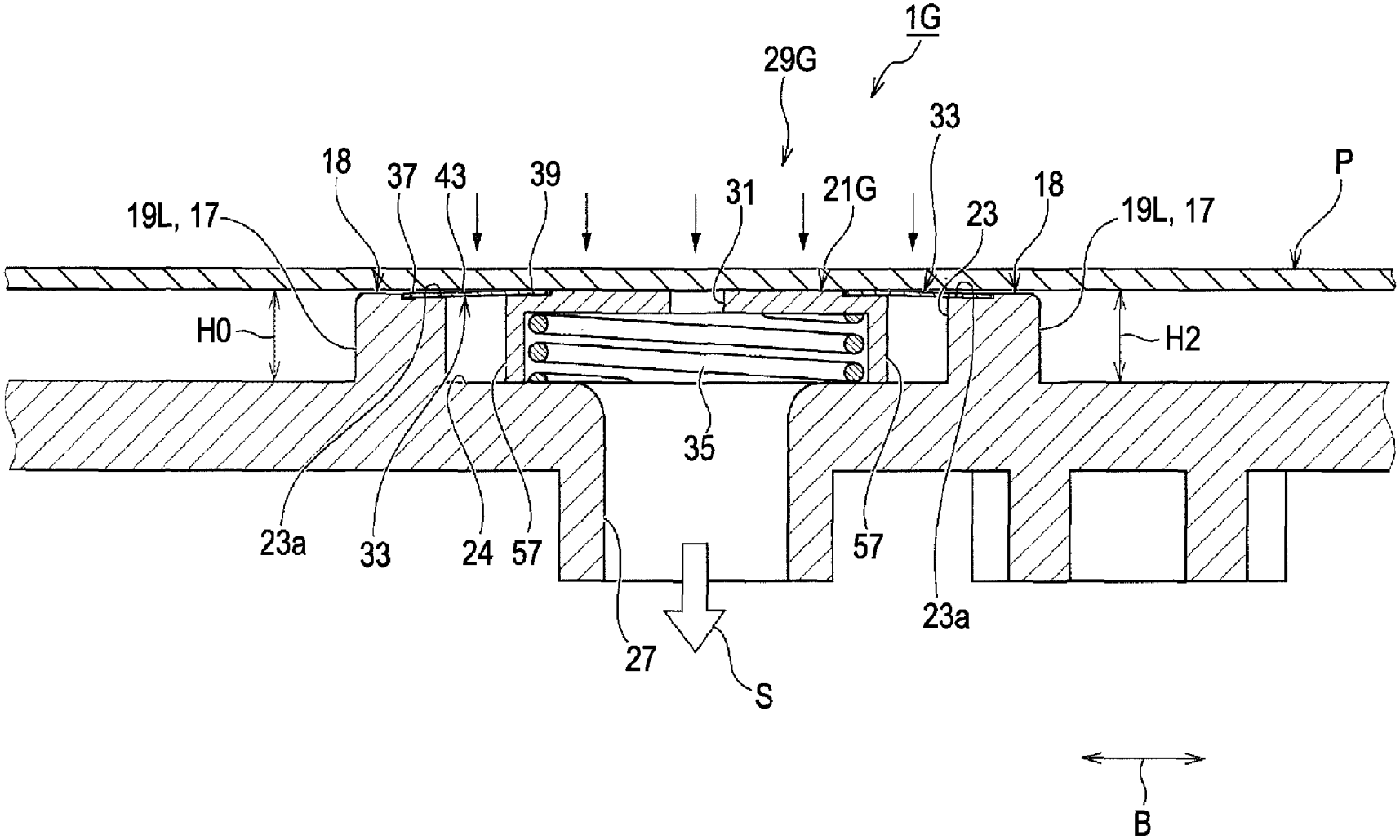
FIG. 11 is a longitudinal sectional front view illustrating an enlarged periphery of a part of a movable adsorption portion at the time of load according to Embodiment 7 of the invention.

Embodiment 7 (see FIG. 11)

An ink jet printer 1G (to which sign G is attached to distinguish the ink jet printer of Embodiment 7 from the ink jet printer of other embodiments) according to Embodiment 7 basically has the same configuration as that of the ink jet printer 1A of Embodiment 1 shown in FIGS. 1 to 5. Therefore, a movable adsorption portion 29G includes the pressure receiving sheet 33 and the compression coil spring 35, which are the same as those of Embodiment 1.

In this embodiment, the abutting portion 57 is formed by downwardly bending the circumference of a pressure receiving portion 21G with a circular plate form. Therefore, since the lower surface of the abutting portion 57 comes into contact with the bottom 24 of the suction groove 23, the lower limit position H2 of the operation height of the pressure receiving portion 21G to the sheet P is set.

With the movable adsorption portion 29G having this configuration, it is possible to obtain the same advantage as that of Embodiment 1. Moreover, since the lower limit position H2 of the operation height of the pressure receiving portion 21G to the sheet P is exactly managed, the sheet P can be smoothly adsorbed and supported, the printing can be executed with high precision, and superior transport can be executed reliably.

Figure 12A:
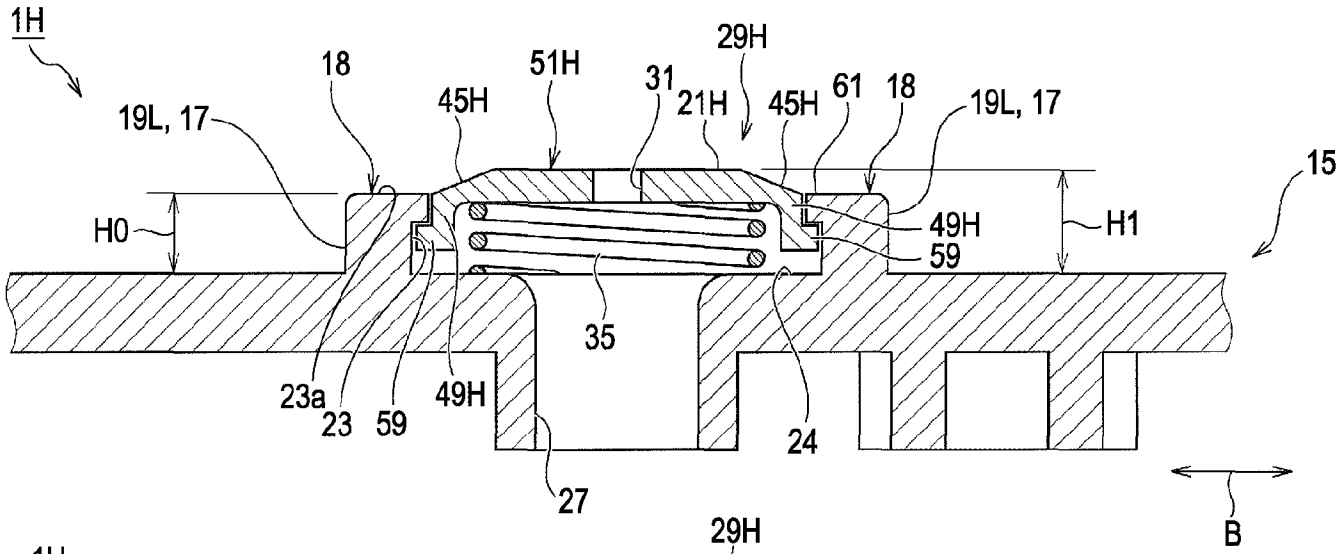
FIGS. 12A and 12B are longitudinal sectional front views illustrating an enlarged periphery of a part of a movable adsorption portion at the time of no load and at the time of load, respectively, according to Embodiment 8 of the invention.
Figure 12B:
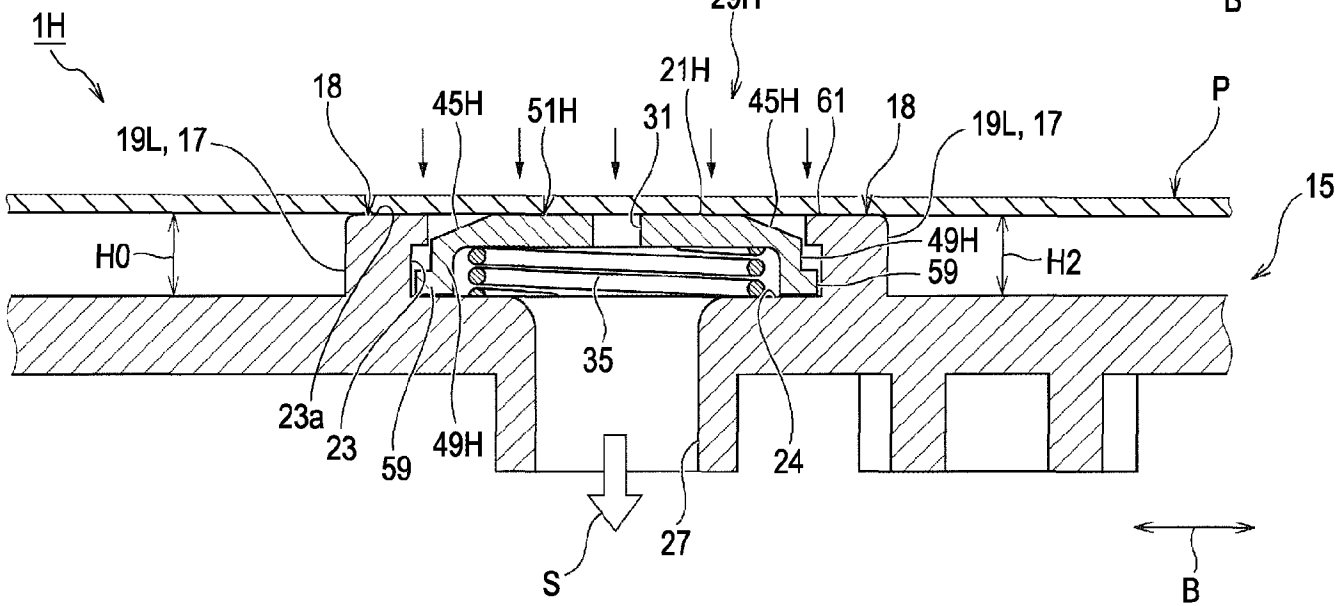

Embodiment 8 (see FIGS. 12A and 12B)

An ink jet printer 1H (to which sign H is attached to distinguish the ink jet printer of Embodiment 8 from the ink jet printer of other embodiments) according to Embodiment 8 basically has the same configuration as that of the ink jet printer 1D of Embodiment 4 shown in FIG. 8. Therefore, a movable adsorption portion 29H includes a pressure receiving tube 51H and the compression coil spring 35, which are the same as those of Embodiment 1.

In this embodiment, the pressure receiving sheet 33 installed in Embodiment 1 is not provided, but the movable adsorption portion 29H is directly inserted into the suction groove 23.

In this embodiment, since the pressure receiving tube 51H has a pressure receiving portion 21H and a side body portion 49H, as in Embodiment 4, a rectilinear guide inclination surface 45H tapered obliquely in the boundary between the pressure receiving portion 21H and the side body portion 49H is formed.

Since the lower end of the side body portion 49H is extracted outward in a hook shape, the lower end of the side body portion 49H is formed as the abutting portion 59.

A locking portion 61 extracted in a brim shape toward the inside of the upper circumference 23*a* of the suction groove 23 is provided. The upper surface of the abutting portion 59 comes into contact with the lower surface of the locking portion 61. Therefore, the upper limit position H1 of an operation height of the pressure receiving portion 21H to the sheet P is set. The lower surface of the abutting portion 59 comes into contact with the bottom 24 of the suction groove 23. Therefore, the lower limit position H2 of the operation height of the pressure receiving portion 21H relative to the sheet P is set.

With the movable adsorption portion 29H having this configuration, it is possible to obtain the same advantage as that of Embodiment 4. Moreover, since the upper limit position H1 and the lower limit position H2 of the operation height of the pressure receiving portion 21H to the sheet P are exactly managed, the sheet P can be smoothly adsorbed and supported, the printing can be executed with high precision, and superior transport can be executed more reliably.

(Other Embodiments)

The printing apparatus 1 according to an aspect of the invention has the above-described configuration, but may be modified partially or omitted in various forms within the scope of the invention without departing from the gist of the invention.

For example, when the upper limit position H1 and the lower limit position H2 of the operation height of the pressure receiving portion 21 to the sheet P can be exactly managed by adjusting or setting the movable range of the urging member 35, the abutting portions 55, 57, and 59 according to Embodiment 6 to Embodiment 8 may be omitted.

The urging member is not limited to the compression coil spring 35, but various urging members such as a plate spring, a rubber-like elastic member, and an urging member using an air damper operation may be used. When the pressure receiving sheet 33 of Embodiment 1 is formed of an elastic material, the separate compression coil spring 35 may be omitted.

The configurations of Embodiment 1 to Embodiment 8 can be appropriately combined. Alternatively, the movable adsorption portions 29 and the suction grooves 23 with another configuration may be applied instead of the plurality of movable adsorption portions 29 and suction grooves 23 aligned in the width direction B of the sheet support unit 15.

What is claimed is:

1. A printing apparatus comprising:

a printing medium support unit supporting a printing medium supplied to a print execution area and guiding the printing medium being transported, wherein the printing medium support unit includes:

a support portion supporting the printing medium supplied to the print execution area and defining a predetermined gap with a print head;

a suction groove formed concavely on a support surface of the support portion;

a suction opening formed in the suction groove and communicating with a suction source; and a movable adsorption portion disposed in the suction groove and having a suction hole, wherein before the printing medium is supplied, the movable adsorption portion is located at an upper limit position higher than a support height of the support portion, and wherein when the printing medium is supplied, the suction hole is blocked by the printing medium, a space of negative pressure is formed on the basis of the suction source, and thus the movable adsorption portion is moved to a lower limit position equal to or lower than the support height of the support portion by the negative pressure.

2. The printing apparatus according to claim 1, wherein the movable adsorption portion includes:

a plate-shaped pressure receiving portion in which the suction hole is formed; and a pressure receiving sheet which is disposed so as to cover a space between a circumference of the pressure receiving portion and a circumference of the suction groove and is deformed flexibly.

3. The printing apparatus according to claim 1, wherein the movable adsorption portion includes:

a plate-shaped pressure receiving portion in which the suction hole is formed; and a tubular wrinkle portion disposed across a bottom of the suction groove from a circumference of the pressure receiving portion.

4. The printing apparatus according to claim 1, wherein the movable adsorption portion includes a cap-shaped pressure receiving tube including:

a flat pressure receiving portion in which the suction hole is formed; and a side body portion extending from a circumference of the pressure receiving portion to a bottom of the suction groove.

5. The printing apparatus according to claim 1, wherein the movable adsorption portion is transited to the upper limit position by an urging force of an urging member.

6. The printing apparatus according to claim 1, wherein an abutting portion which sets either or both of the upper limit position and the lower limit portion of the movable adsorption portion is disposed in either or both of the movable adsorption portion and the suction groove.

7. The printing apparatus according to claim 1, wherein a guide inclination surface burying a step difference between a circumference of the movable adsorption portion and a circumference of the suction groove is formed between the circumference of the movable adsorption portion and the circumference of the suction groove.

* * * * *